US011739913B2

(12) United States Patent
Jiang

(10) Patent No.: US 11,739,913 B2
(45) Date of Patent: Aug. 29, 2023

(54) EFFECT DEVICE EASY TO MOUNT

(71) Applicant: Guangzhou Haoyang Electronic Co., Ltd., Guangdong (CN)

(72) Inventor: Weikai Jiang, Guangdong (CN)

(73) Assignee: GUANGZHOU HAOYANG ELECTRONIC CO., LTD., Guangdong (CN)

( * ) Notice: Subject to any disclaimer, the term of this patent is extended or adjusted under 35 U.S.C. 154(b) by 0 days.

(21) Appl. No.: 17/457,015

(22) Filed: Nov. 30, 2021

(65) Prior Publication Data

US 2022/0082232 A1 Mar. 17, 2022

Related U.S. Application Data

(63) Continuation of application No. PCT/CN2020/110155, filed on Aug. 20, 2020.

(30) Foreign Application Priority Data

Jan. 21, 2020 (CN) ..... 202020139442.5

(51) Int. Cl.
*F21V 14/00* (2018.01)
*F21V 17/02* (2006.01)
*F21W 131/406* (2006.01)

(52) U.S. Cl.
CPC ..... *F21V 17/02* (2013.01); *F21W 2131/406* (2013.01)

(58) Field of Classification Search
CPC ..... F21V 11/04; F21V 11/065; F21V 11/02; F21V 11/06; F21V 14/08; F21V 11/18; F21V 11/183; F21V 17/02; F21W 2131/406; F21S 10/007
See application file for complete search history.

(56) References Cited

U.S. PATENT DOCUMENTS 1,525,541 A * 2/1925 Hall ..... F21V 14/08 340/331
8,797,663 B1 * 8/2014 Bouckaert ..... F21V 17/02 359/889

(Continued)

FOREIGN PATENT DOCUMENTS

CN 2079704 U 6/1991
CN 103032737 A 4/2013
CN 109442301 A 3/2019

(Continued)

*Primary Examiner* — Y M. Quach Lee
(74) *Attorney, Agent, or Firm* — Muncy, Geissler, Olds & Lowe, P.C.

(57) ABSTRACT

An effect device easy to mount includes an annular frame, effect sheets and fixing assemblies for pivoting the effect sheets in the annular frame. The fixing assembly has a first insertion pin and a second insertion pin respectively mounted at two ends of the effect sheets and used for pivoting. The first insertion pin is sleeved with an elastic element and an end portion of the first insertion pin penetrates through a mounting hole in the annular frame. A first protruding portion protrudes out of an end, close to the effect sheets, of the first insertion pin. One end of the elastic element abuts against the first protruding portion, and the other end of the elastic element abuts against an inner side wall of the annular frame. The second insertion pin is fixed in a pivoting mode.

20 Claims, 6 Drawing Sheets

(56) References Cited

U.S. PATENT DOCUMENTS

| | | | | |
|---|---|---|---|---|
| 2008/0062684 | A1 | 3/2008 | Belliveau et al. | |
| 2010/0246182 | A1* | 9/2010 | Jurik ..... | F21S 10/007<br>362/277 |

FOREIGN PATENT DOCUMENTS

| | | | |
|---|---|---|---|
| CN | 208920006 | U | 5/2019 |
| CN | 111594775 | A | 8/2020 |

* cited by examiner

EFFECT DEVICE EASY TO MOUNT

CROSS REFERENCE TO RELATED APPLICATIONS

The present application is a continuation of International Application No. PCT/CN2020/110155, filed on Aug. 20, 2020, which claims priority from Chinese Patent Application No. 202020139442.5 filed on Jan. 21, 2020, all of which are hereby incorporated herein by reference.

TECHNICAL FIELD

The invention relates to the technical field of stage lights, and more particularly, relates to an effect device easy to mount.

BACKGROUND ART

In production of many TV and stage lighting programs, lighting engineers use different lighting effects to heighten the atmosphere for the program and enhance the program effect. Most of bright stage lighting effects are actually achieved based on a variety of effect sheets, such as stage light color sheets, gobos and dynamic fire discs.

With development of science and technology, the technology in the field of stage lights changes with each passing day. Users are pursuing richer glowing effects, for example, by adding loose-leaf effect sheets in light fixtures, one can choose to increase a frosting effect on light beams. However, a fixed installation method of the existing loose-leaf effect sheets is complicated, the effect sheets may be easily damaged in the replacement process, and lots of time is consumed in disassembling and assembling, causing high production and maintenance costs.

SUMMARY OF THE INVENTION

The present invention thus provides an effect device easy to mount. According to the present invention, effect sheets can be easily and rapidly mounted and fixed above a light output direction with tension of springs.

According to the present invention, the effect device easy to mount includes an annular frame, a plurality of effect sheets and a plurality of fixing assemblies for fixing the effect sheets in the annular frame. Each of the fixing assembly includes a first insertion pin and a second insertion pin respectively mounted at two ends of each effect sheet and used for fixing the effect sheets in the annular frame in a plug-in mode. The first insertion pin is sleeved with an elastic element and an end portion of the first insertion pin penetrates through a mounting hole in the annular frame. A first protruding portion protrudes out of an end, close to each effect sheet, of the first insertion pin. One end of the elastic element abuts against the first protruding portion, and the other end of the elastic element abuts against an inner side wall of the annular frame. The second insertion pin is fixed in the plug-in mode.

The effect device easy to mount in the present invention, the first insertion pin is sleeved with the elastic element, one end of the elastic element abuts against the inner side wall of the annular frame, and the other end of the elastic element abuts against the first protruding portion on the first insertion pin, the second insertion pin is plugged into the effect sheets. With such configuration, in normal work, each effect sheet is fixed by extruding of the elastic element. However, in a process of disassembling and assembling the effect sheets, room for the second insertion pin to be withdrawn can be made just by compressing the elastic element, so that the effect sheets are easily and rapidly disassembled and assembled. Therefore, the device according to the present embodiment is simple in disassembling and assembling steps, time for disassembling and assembling the effect sheets is greatly shortened, damage to the effect sheets in the disassembling and assembling process is relieved, and low producing and maintaining costs are achieved.

According to one embodiment of the present invention, the effect sheets are radially distributed around a center of the annular frame. When the annular frame is in circular chape, such design allows the effect sheets to be consistent in shapes and size, causing flexible mounting, batch producing and machining can be performed, thus reducing cost.

A center shaft located at a center position of the annular frame is provided. The center shaft is provided with an inserting hole for the second insertion pin to be plugged in. A second protruding portion protrudes out of an end, close to each effect sheet, of the second insertion pin, and the second protruding portion abuts against the center shaft. The effect sheets are fixed between the annular frame and the center shaft through the first insertion pin and the second insertion pin, making the effect sheets distributed radially. By arranging the center shaft to mount the second insertion pin, a distance between two fixed ends of the effect sheets can be shortened, so that the effect sheets can be mounted more stably, and the effect sheets can be prevented from shaking during work.

According to the present invention, the annular frame includes a first frame body and a second frame body. A first clamping groove is formed in a top of the first frame body. The second frame body is press-fitted on the top of the first frame body, and an edge, close to the first frame body, of the second frame body is matched with the first clamping groove to form the mounting hole. When the first insertion pin is placed in the first clamping groove, the second frame body is press-fitted on the top of the first frame body to prevent the first insertion pin from being separated from the mounting hole. With this arrangement, the first insertion pin is disassembled from/assembled with the annular frame more conveniently and quickly.

According to another embodiment of the present invention, the effect sheets are arranged side by side. When the annular frame is in square shape, the effect sheets are enabled to be consistent in shape and size due to this layout, resulting in flexible mounting, batch producing and machining can be performed, thus reducing cost.

The second insertion pin penetrates through the other mounting hole in the annular frame. A second protruding portion protrudes out of an end, close to each effect sheet, of the second insertion pin, and the second protruding portion abuts against the inner side wall of the annular frame. With such configuration, the effect device has a simple structure, reducing mounting parts of the effect sheets, and thus achieving simple mounting of the effect sheets.

According to the present invention, the device further includes a driving mechanism driving the effect sheets to rotate and a transmission component for transmitting power of the driving mechanism to the effect sheets. The power of the driving mechanism is conducted to the effect sheets through the transmission assembly, so that the effect sheets rotate by different angles, and the effect device renders effects of light beams passing through it to different extents.

According to the present invention, the transmission component includes transmission shafts arranged corresponding to the first insertion pins and moving in a circumferential direction of the annular frame. Rotating blocks are correspondingly pivoted to the transmission shafts. The transmission component further includes shifting rods fixedly connected with the first insertion pins, and the shifting rod is connected with the rotating block in a sliding mode. With such configuration, the transmission shaft drives the rotating block to move in a circumferential direction, and the shifting rod is driven to swing, so that the first insertion pin rotates by a certain angle, thus achieving a rotating effect of the effect sheets.

According to the present invention, the transmission component further includes a gear ring and a rotating frame. The gear ring coincides with a center shaft of the rotating frame, the rotating frame is fixedly connected with the gear ring, the transmission shafts are all fixed to the rotating frame, and sawteeth on the gear ring are engaged with a driving wheel of the driving mechanism. In this way, when the driving wheel rotates, the gear ring is driven to rotate, the transmission shaft can be driven to move at the same speed in the circumferential direction, so that the effect sheets rotate by a unified angle at a unified speed, and rotating consistency of the effect sheets is guaranteed.

According to the present invention, the effect sheets have a first state and a second state. The effect sheets are parallel to a center line of the annular frame when the effect sheets are in the first state. When the effect sheets are in the second state, an included angle between the effect sheets and the center line of the annular frame is an acute angle or a right angle. Rotation of the effect sheets is achieved, and the effect sheets can adjust the state according to different performance demands. When the effect sheets are in the first state, the effect sheets are distributed in the annular frame fully, and effects of the light beams passing through the effect sheets are sufficiently rendered. When the effect sheets are in the second state, the light beam passes through the effect sheets for effect adjustment, similarly, different light effects may be presented with angle transformation of the effect sheets, obtaining enriched stage effects. If the included angle between the effect sheets and the center line of the annular frame is in right angle, the light beam will pass through between adjacent effect sheets, which plays no effect rendering role in the light beam.

According to the present invention, each effect sheet is a frosting sheet. The light beam passing through the frosting sheet is frosted, making the color and light spots of the light beam uniform.

DETAILED DESCRIPTION

The accompanying drawings of the invention are only for illustrative descriptions and cannot be understood as a limitation to the invention. In order to better illustrate the following embodiments, some parts of the accompanying drawings may be omitted, enlarged or reduced, and do not represent a size of an actual product; and it is understandable for those skilled in the art that some well-known structures in the accompanying drawings and their descriptions may be omitted.

Figure 1:
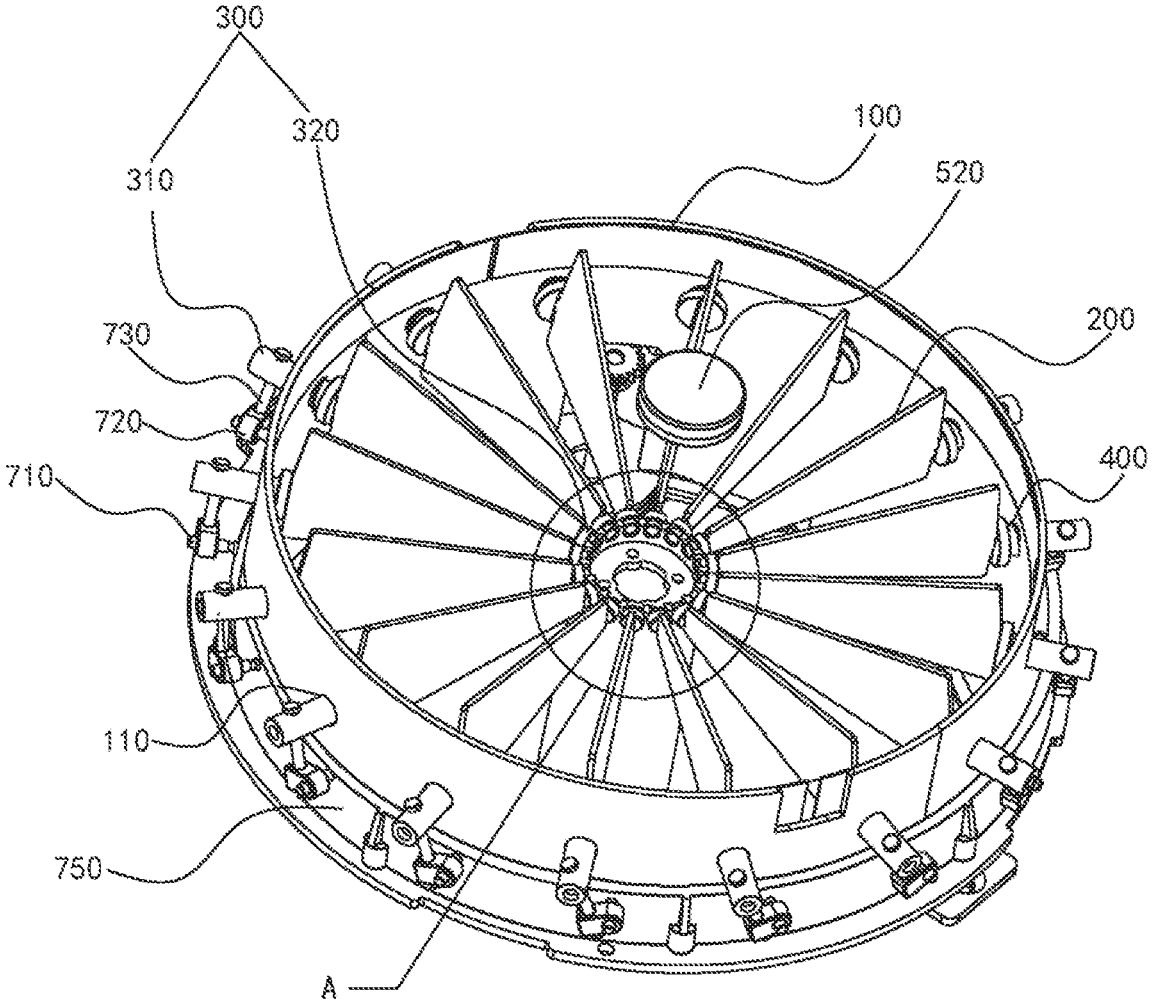
FIG. 1 is a schematic structural diagram of an effect device easy to mount according to one embodiment of the present invention.

As shown in FIG. 1, an effect device easy to mount is provided, including an annular frame 100, a plurality of effect sheets 200 and a plurality of fixing assemblies 300 for fixing the plurality of effect sheets 200 in the annular frame 100. Each of the fixing assembly 300 includes a first insertion pin 310 and a second insertion pin 320 respectively mounted at two ends of each effect sheet 200 and used for fixing the plurality of effect sheets 200 in the annular frame 100 in a plug-in mode. The first insertion pin 310 is sleeved with an elastic element 400. An end portion of the first insertion pin 310 penetrates through a mounting hole 110 in the annular frame 100. A first protruding portion 311 protrudes out of an end, close to the effect sheets 200, of the first insertion pin 310. One end of the elastic element 400 abuts against the first protruding portion 311, and the other end of the elastic element 400 abuts against an inner side wall of the annular frame 100. The second insertion pin 320 is fixed in the plug-in mode.

According to the device for easily mounting the effect sheets of the present embodiment, the first insertion pin 310 is sleeved with the elastic element 400, one end of the elastic element 400 abuts against the inner side wall of the annular frame 100, and the other end of the elastic element 400 abuts against the first protruding portion 311 on the first insertion pin 310. The second insertion pin 320 is plugged into the effect sheets. With such configuration, in normal work, each effect sheet 200 is fixed by extruding of the elastic element 400. However, in a process of disassembling and assembling the effect sheets 200, room for the second insertion pin 320 to be withdrawn can be made only by compressing the elastic element 400, so that the effect sheets 200 can be easily and rapidly disassembled and assembled. Therefore, the device according to the present embodiment is simple in disassembling and assembling steps, time for disassembling and assembling the effect sheets is greatly shortened, damage to the effect sheets 200 in the disassembling and assembling process is relieved, and low producing and maintaining costs are achieved.

In a preferable embodiment, the mounting hole 110 is a through hole, the first insertion pin 310 may penetrate through the mounting hole 110. With such configuration, when the effect sheets 200 are disassembled and assembled, more room can be made for the second insertion pin 320 to be withdrawn, resulting in simpler and more convenient disassembling and assembling.

As shown in FIG. 1, in a preferred embodiment of the invention, the effect sheets 200 are radially distributed around a center of the annular frame 100. When the annular frame 100 is in circular shape, such design allows the effect sheets 200 to be consistent in shape and size, causing flexible mounting, batch producing and machining can be performed, thus reducing the cost.

Figure 2:
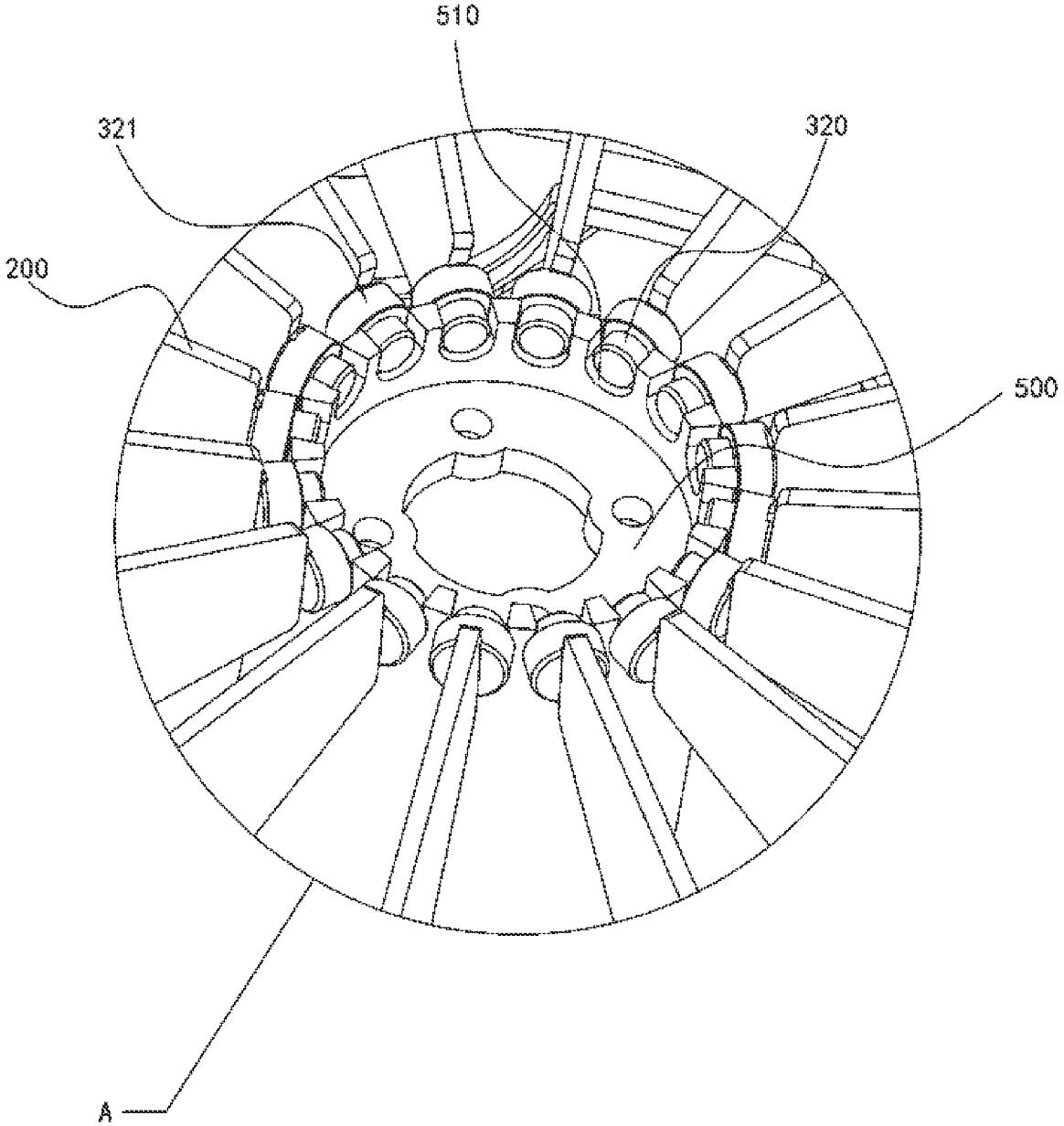
FIG. 2 is a partial enlarged view of part A of FIG. 1.
Figure 3:
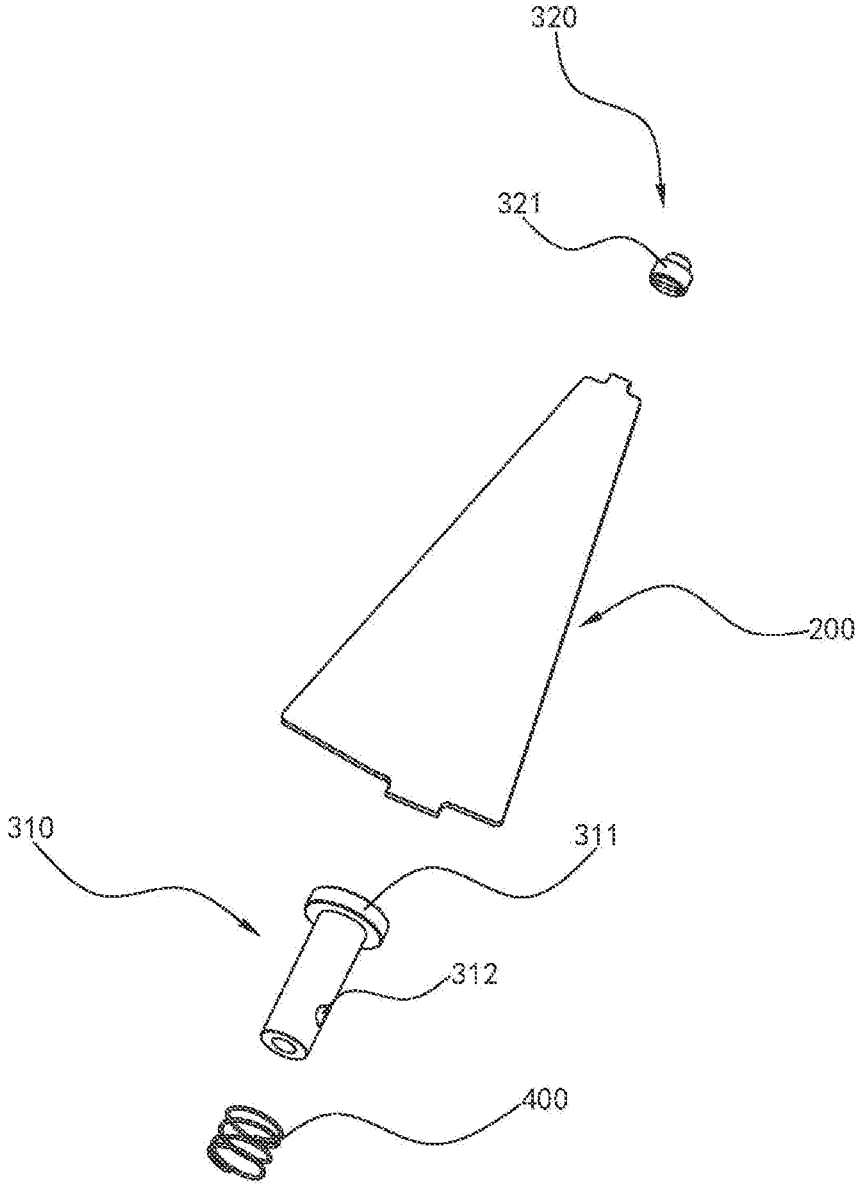
FIG. 3 is a schematic structural diagram of effect sheets and fixing assemblies in cooperation according to one embodiment of the present invention.

As shown in FIG. 1 and FIG. 2, in a preferred embodiment of the invention, a center shaft 500 located at a center position of the annular frame 100 is provided. The center shaft 500 is provided with an inserting hole 510 for the second insertion pin 320 to be inserted. A second protruding portion 321 protrudes out of an end, close to the effect sheets 200, of the second insertion pin 320, and the second protruding portion 321 abuts against the center shaft 500. The effect sheets 200 are fixed between the annular frame 100 and the center shaft 500 through the first insertion pin 310 and the second insertion pin 320, making the effect sheets 200 distributed radially. By arranging the center shaft 500 to mount the second insertion pin 320, a distance between two fixed ends of the effect sheets 200 can be shortened, so that the effect sheets 200 are mounted more stably, and the effect sheets 200 are prevented from shaking during work.

Preferably, a diameter of the second insertion pin 320 is slightly smaller than a diameter of the inserting hole 510, and the diameter of the inserting hole 510 is smaller than a diameter of the second protruding portion 321. This arrangement enables the second protruding portion 321 to achieve an abutting action and prevents the effect sheets 200 from loosening.

Optionally, a top of the center shaft 500 is provided with a second clamping groove and a pressing cover 520. The inserting hole 510 is formed by the second clamping groove cooperating with the pressing cover 520. When the effect sheets 200 are completely installed, by press-fitting the pressing cover 520 at an upper end of the second clamping groove, and fixedly connecting the pressing cover 520 with the center shaft 500 via a screw, the second insertion pin 320 is stably fixed to the center shaft 500, and the effect sheets 200 will be not prone to falling off during work.

Preferably, two ends of the effect sheets 200 connected to the fixing assembly 300 are provided with protrusions, one side of the first protruding portion 311 and one side of the second protruding portion 321 close to the effect sheets 200 are provided with grooves for the protrusions to be inserted. With such design, the protrusion can be fixed to the groove through adhesive dispensing, so that the first insertion pin 310 and the second insertion pin 320 can be fixed to the two ends of the effect sheets 200.

Figure 5:
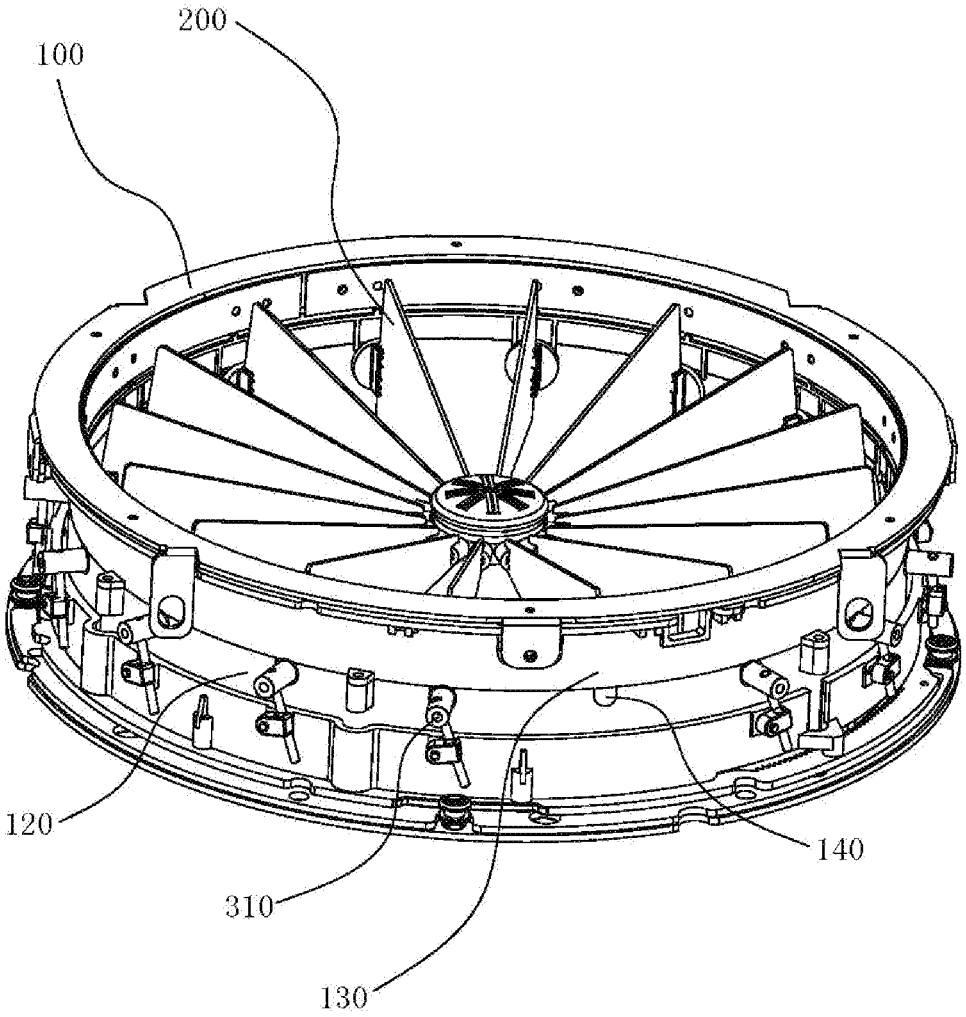
FIG. 5 is a schematic structural diagram of an annular frame, which is split into a first frame body and a second frame body, according to one embodiment of the present invention.

As shown in FIG. 1 and FIG. 5, in a preferred embodiment of the invention, the annular frame 100 includes a first frame body 120 and a second frame body 130. A first clamping groove 140 is formed in a top of the first frame body 120. The second frame body 130 is press-fitted on the top of the first frame body 120, and an edge, close to the first frame body 120, of the second frame body 130 forms the mounting hole 110 with the first clamping groove 140. When the first insertion pin 310 is placed in the first clamping groove 140, the second frame body 130 is press-fitted on the top of the first frame body 120 to prevent the first insertion pin 310 from being separated from the mounting hole 110. With this arrangement, the first insertion pin 310 is disassembled from/assembled with the annular frame 100 more conveniently and quickly. When the second frame body 130 is tightly pressed above the annular frame 100, the second frame body 130 is fixedly connected with the annular frame 100 through a screw, so that the effect sheets 200 are prevented from falling off during work.

Preferably, a bottom of the first clamping groove 140 matches with the first insertion pin 310 in shape and size. When the second frame body 130 is fixed to the first frame body 120, a depth of the mounting hole 110 is equal to or slightly greater than a diameter of the first insertion pin 310. With this arrangement, the insertion pin 310 can freely rotate in the mounting hole 110, which also facilitates the processing of the fixed frame 130.

Figure 6:
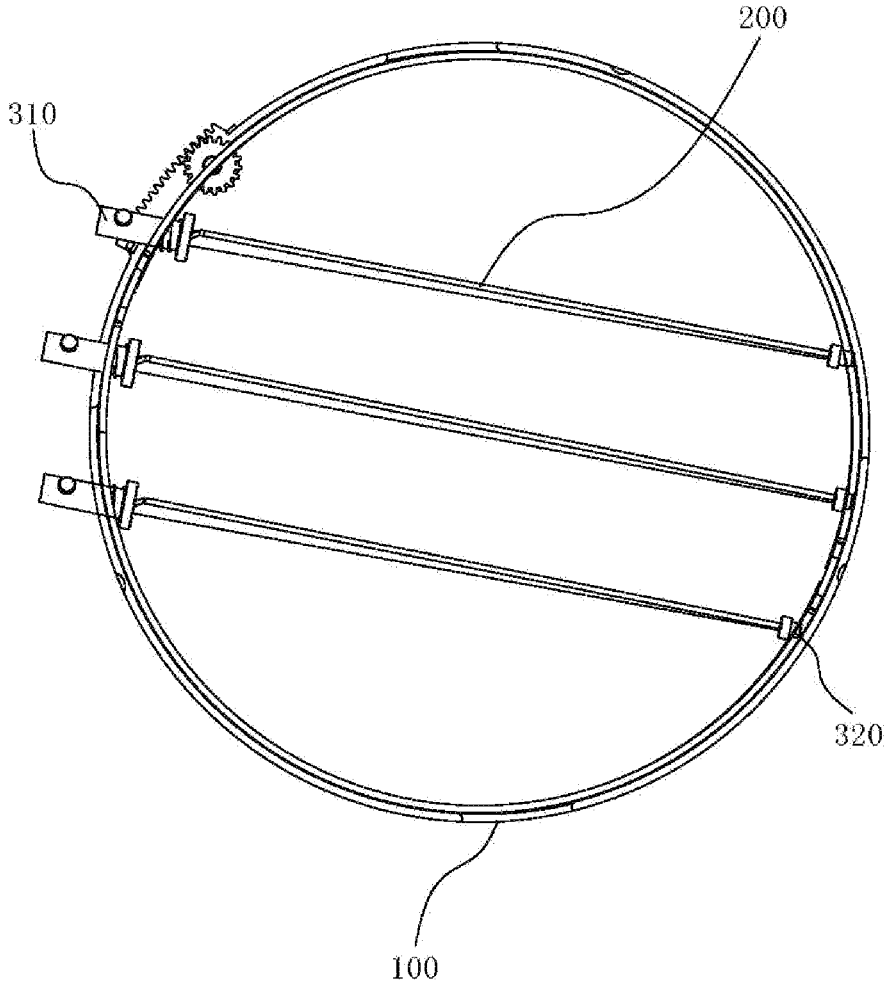
FIG. 6 is a schematic structural diagram of an effect device easy to mount according to another embodiment of the present invention.

As shown in FIG. 6, in a preferred embodiment of the invention, the effect sheets 200 are arranged side by side. When the annular frame 100 is in square shape, the effect sheets 200 are enabled to be consistent in shape and size due to this layout, resulting in flexible mounting, batch producing and machining can be performed, thus reducing the cost.

In the embodiment, the second insertion pin 320 penetrates through another mounting hole 110 in the annular frame 100. A second protruding portion 321 protrudes out of an end, close to the effect sheets 200, of the second insertion pin 320, and the second protruding portion 321 abuts against the inner side wall of the annular frame 100. With such configuration, the effect device is simple in structure, reducing mounting parts of the effect sheets 200, and achieving simple mounting of the effect sheets 200. In mounting process of the effect sheets 200, the first insertion pin 310 is firstly inserted into the mounting hole 110, a distance between the effect sheets 200 and the annular frame 100 is shortened by compressing the elastic element 400, then the second insertion pin 320 is aligned with the other mounting hole 110 to be plugged in, after that, the effect sheets 200 are loosened, when elasticity of the elastic element 400 recovers, the effect sheets 200 can be fixed in the annular frame 100.

In some embodiments, except for the first insertion pin 310, the second insertion pin 320 may also be sleeved with an elastic member 400, one end of the elastic element 400 is enabled to abut against the second protruding portion 321, and the other end of the elastic element 400 abuts against the inner side wall of the annular frame 100. The elastic member 400 located at the first insertion pin 310 exerts pressure A on the effect sheets by abutting against the first protruding portion 311, and the elastic member 400 located at the second insertion pin 320 exerts pressure B on the effect sheets by abutting against the second protruding portion 321. As pressure A and pressure B are opposite in direction, the effect sheets 200 will be more closely connected with the fixing assembly 300.

Figure 4:
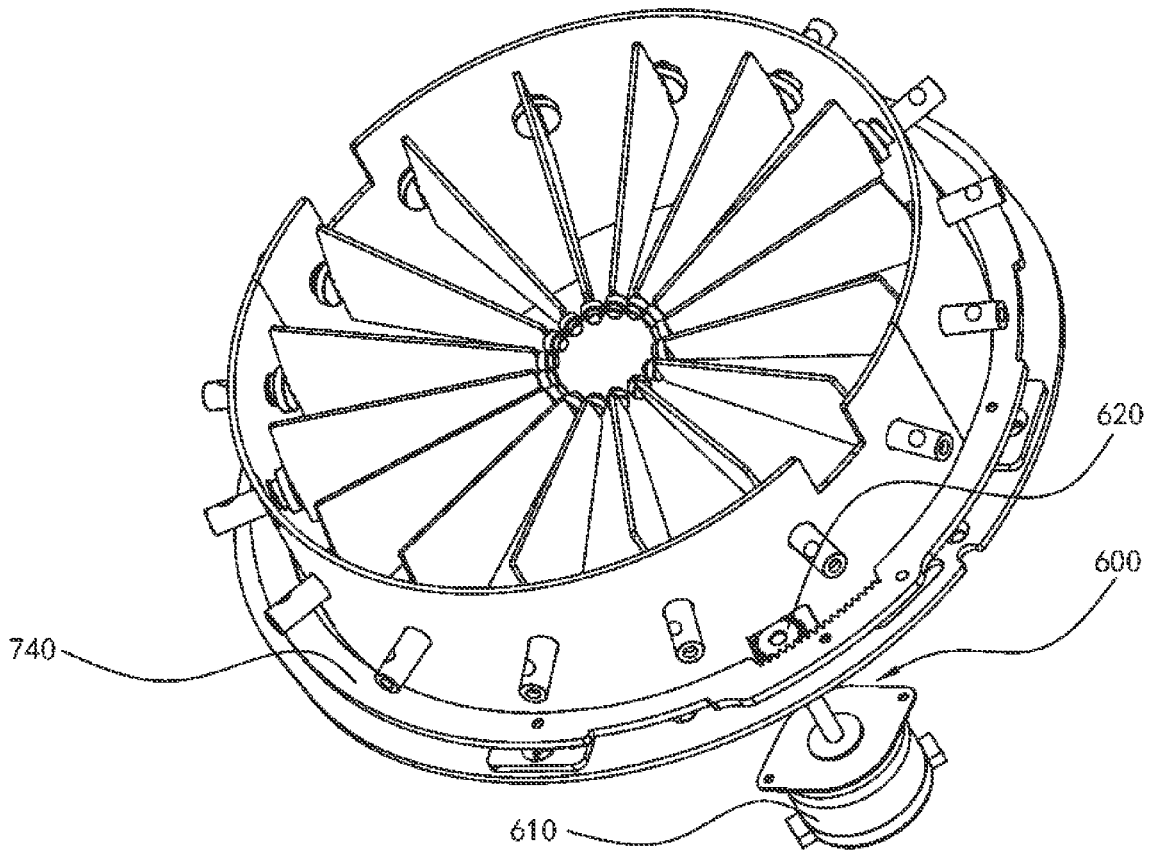
FIG. 4 is a schematic structural diagram of a transmission assembly, in which a gear ring is removed, according to one embodiment of the present invention.

As shown in FIG. 1 and FIG. 4, in a preferred embodiment of the invention, the device further includes a driving mechanism 600 driving the effect sheets 200 to rotate and a transmission component for transmitting power of the driving mechanism 600 to the effect sheets 200. The power of the driving mechanism 600 is conducted to the effect sheets 200 through the transmission component, so that the effect sheets 200 can rotate by different angles, and the effect device renders effects of light beams passing through it in a gradual change mode.

Preferably, the driving mechanism 600 includes a motor 610 and a driving wheel 620 fixedly connected to a rotating shaft of the motor 610.

As shown in FIG. 1 and FIG. 4, in a preferred embodiment of the invention, the transmission component includes transmission shafts 710 arranged corresponding to the first insertion pins 310 and moving in a circumferential direction of the annular frame 100. Rotating blocks 720 are correspondingly pivoted to the transmission shafts 710. The transmission component further includes shifting rods 730 fixedly connected with the first insertion pins 310. The shifting rod 730 is in sliding connection with the rotating block 720. Due to the fact that the rotating block 720 is pivoted to the transmission shaft 710, when the transmission shaft 710 drives the rotating block 720 to move in a circumferential direction, the rotating block 720 may rotate simultaneously. However, the shifting rod 730 is connected with the rotating block 720 in the sliding mode, the shifting rod 730 may be driven to swing by the circumferential movement of the rotating block 720, so that the first insertion pin 310 can rotate by a certain angle, thus achieving a rotating effect of the effect sheets 200.

As shown in FIG. 1, preferably, one end, stretching out of the annular frame 100, of the first insertion pin 310 is provided with a connecting hole 312 into which the shifting rod 730 is plugged and fixedly mounted.

In other embodiments, the transmission shafts 710 correspond to the driving mechanisms 600 one to one, so that each of the effect sheets 200 can be independently controlled, and each of the effect sheets 200 in the effect device can rotate by different angles at the same time to render the light beam passing through the effect device to different degrees, for example, light spots exhibit a gradual change effect.

As shown in FIG. 1 and FIG. 4, in a preferred embodiment of the invention, the transmission component further includes a gear ring 740 and a rotating frame 750. The gear ring 740 coincides with a center shaft of the rotating frame 750, the rotating frame 750 is fixedly connected with the gear ring 740, the transmission shafts 710 are all fixed to the rotating frame 750, and sawteeth on the gear ring 740 are engaged with the driving wheel 620 of the driving mechanism 600. In this way, when the driving wheel 620 rotates, the gear ring 740 is driven to rotate, the transmission shaft 710 can be driven to move at the same speed in the circumferential direction, so that the effect sheets 200 rotate by a unified angle at a unified speed, and rotating consistency of the effect sheets 200 is guaranteed.

Preferably, the rotating frame 750 is fixedly connected above the gear ring 740 by a screw along a light output direction of the light beam passing through the effect sheets 200, the rotating frame 750 is sleeved on an outer side wall of the annular frame 100, and the gear ring 740 is fixedly arranged below the annular frame 100. In this embodiment, the sawteeth on the gear ring 740 are located on an inner side of the gear ring 740, and the driving wheel 620 is engaged with the gear ring 740 on the inner side of the gear ring 740.

However, in other embodiments, the rotating frame 750 can be fixedly connected below the gear ring 740 by a screw along a light output direction of the light beam passing through the effect sheets 200, the rotating frame 750 is sleeved on an outer side wall of the annular frame 100, the gear ring 740 is fixedly arranged above the annular frame 100, the sawteeth on the gear ring 740 are located on an outer side of the gear ring 740, and the driving wheel 620 is engaged with the gear ring 740 on the outer side of the gear ring 740.

As shown in FIG. 1 and FIG. 4, in a preferred embodiment of the invention, effect sheets 200 have a first state and a second state. The effect sheets 200 are parallel to a center line of the annular frame 100 when the effect sheets 200 are in the first state. When the effect sheets 200 are in the second state, an included angle between the effect sheets 200 and the center line of the annular frame 100 is an acute angle or a right angle. Rotation of the effect sheets 200 is achieved, and the effect sheets 200 can adjust the state according to different interpretation needs. When the effect sheets 200 are in the first state, the effect sheets 200 are distributed in the annular frame 100 fully, and effects of the light beams passing through the effect sheets 200 are sufficiently rendered. When the effect sheets are in the second state, the effect sheets 200 adjust the effect of part of the light beams, different gradually changing light effects may be presented with angle transformation of the effect sheets 200, obtaining enriched stage effects. If the included angle between the effect sheets 200 and the center line of the annular frame 100 is in right angle, the light beam will pass through between adjacent effect sheets 200, which has no effect rendering role in the light beam.

As shown in FIG. 1, in a preferred embodiment of the invention, each effect sheet 200 is a frosting sheet. The light beam passing through the frosting sheet may be frosted, making the color and light spots of the light beam uniform.

In other embodiments, the effect sheets 200 can be a color sheet, so that light beams passing through the color sheet may be colored, presenting different colors of the light beams. During rotation of the effect sheets 200, the size of color blocks in the formed light spot can change with a rotation angle of the effect sheets 200. Stage effects thus are enriched by transforming colors.

In other embodiments, each effect sheet 200 is a gobo which a light beam pass through may form light spots having multiple patterns. When the gobo is in a process of rotation, the patterns in the formed light spot can change shapes according to a rotation angle of the gobo, which presents a vivid stage effect.

Obviously, the above-mentioned embodiments of the invention are merely examples to clearly illustrate the invention, and are not intended to limit the implementation modes of the invention. For those of ordinary skill in the art, other changes or modifications in different forms can also be made on the basis of the above description. It is unnecessary and impossible to list all the implementation modes here. Any modification, equivalent replacement, improvement and the like made within the spirit and principle of the invention shall be included in the protection scope of the claims of the invention.

The invention claimed is:

1. An effect device easy to mount, comprising:

an annular frame;

a plurality of effect sheets; and a plurality of fixing assemblies for fixing the plurality of effect sheets in the annular frame, each of the plurality of the fixing assemblies having a first insertion pin and a second insertion pin respectively mounted at two ends of the respective effect sheet and used for fixing the plurality of effect sheets in the annular frame in a plug-in mode, wherein the first insertion pin is sleeved with an elastic element and an end portion of the first insertion pin penetrates through a mounting hole in the annular frame, a first protruding portion protrudes out of an end, close to each effect sheet, of the first insertion pin, one end of the elastic element abuts against the first protruding portion, and the other end of the elastic element abuts against an inner side wall of the annular frame, and the second insertion pin is fixed in the plug-in mode, and wherein the annular frame comprises a first frame body and a second frame body, the mounting hole is formed by press-fitting the second frame body on a top of the first frame body.

2. The effect device easy to mount according to claim 1, wherein, the plurality of effect sheets are radially distributed around a center of the annular frame.

3. The effect device easy to mount according to claim 2, further comprising a center shaft located at a center position of the annular frame, wherein the center shaft is provided with an inserting hole for the second insertion pin to be plugged in, a second protruding portion protrudes out of an end, close to each effect sheet, of the second insertion pin, and the second protruding portion abuts against the center shaft.

4. The effect device easy to mount according to claim 1, wherein a first clamping groove is provided in the top of the first frame body, the second frame body is press-fitted on the top of the first frame body, and an edge, close to the first frame body, of the second frame body forms the mounting hole with the first clamping groove.

5. The effect device easy to mount according to claim 1, wherein the plurality of effect sheets are arranged side by side.

6. The effect device easy to mount according to claim 5, wherein the second insertion pin penetrates through another mounting hole in the annular frame, a second protruding portion protrudes out of an end, close to each effect sheet, of the second insertion pin, and the second protruding portion abuts against the inner side wall of the annular frame.

7. The effect device easy to mount according to claim 1, further comprising:

a driving mechanism driving the plurality of effect sheets to rotate; and a transmission component for transmitting power of the driving mechanism to the plurality of effect sheets.

8. The effect device easy to mount according to claim 7, wherein the transmission component comprises:

a plurality of transmission shafts arranged corresponding to the first insertion pins and capable of moving in a circumferential direction of the annular frame, each of the plurality of transmission shafts being pivoted to a rotating block, and a plurality of shifting rods fixedly connected with the respective first insertion pin, each of the plurality of shifting rods being in sliding connection with the rotating block.

9. The effect device easy to mount according to claim 8, wherein the transmission component further comprises a gear ring and a rotating frame, wherein the gear ring coincides with a center shaft of the rotating frame, the rotating frame is fixedly connected with the gear ring, the plurality of transmission shafts are all fixed to the rotating frame, and sawteeth on the gear ring are engaged with a driving wheel of the driving mechanism.

10. The effect device easy to mount according to claim 7, wherein the plurality of effect sheets have a first state and a second state, the plurality of effect sheets are parallel to a center line of the annular frame when the plurality of effect sheets are in the first state, and when the plurality of effect sheets are in the second state, an included angle between the effect sheets and the center line of the annular frame is an acute angle or a right angle.

11. The effect device easy to mount according to claim 1, wherein, the plurality of effect sheets are frosting sheets.

12. An effect device easy to mount, comprising:

an annular frame;

a plurality of effect sheets; and a plurality of fixing assemblies for fixing the plurality of effect sheets in the annular frame, each of the plurality of the fixing assemblies having a first insertion pin and a second insertion pin respectively mounted at two ends of the respective effect sheet and used for fixing the plurality of effect sheets in the annular frame in a plug-in mode, wherein the first insertion pin is sleeved with an elastic element and an end portion of the first insertion pin penetrates through a mounting hole in the annular frame, a first protruding portion protrudes out of an end, close to each effect sheet, of the first insertion pin, one end of the elastic element abuts against the first protruding portion, and the other end of the elastic element abuts against an inner side wall of the annular frame, the second insertion pin is fixed in the plug-in mode, and wherein the effect device further comprises a driving mechanism driving the plurality of effect sheets to rotate; and a transmission component for transmitting power of the driving mechanism to the plurality of effect sheets, the transmission component comprising:

a plurality of transmission shafts arranged corresponding to the first insertion pins and capable of moving in a circumferential direction of the annular frame, each of the plurality of transmission shafts being pivoted to a rotating block, and a plurality of shifting rods fixedly connected with the respective first insertion pin, each of the plurality of shifting rods being in sliding connection with the rotating block.

13. The effect device easy to mount according to claim 12, wherein, the plurality of effect sheets are radially distributed around a center of the annular frame.

14. The effect device easy to mount according to claim 13, further comprising a center shaft located at a center position of the annular frame, wherein the center shaft is provided with an inserting hole for the second insertion pin to be plugged in, a second protruding portion protrudes out of an end, close to each effect sheet, of the second insertion pin, and the second protruding portion abuts against the center shaft.

15. The effect device easy to mount according to claim 12, wherein the annular frame comprises a first frame body and a second frame body, a first clamping groove is provided in a top of the first frame body, the second frame body is press-fitted on the top of the first frame body, and an edge, close to the first frame body, of the second frame body forms the mounting hole with the first clamping groove.

16. The effect device easy to mount according to claim 12, wherein the plurality of effect sheets are arranged side by side.

17. The effect device easy to mount according to claim 16, wherein the second insertion pin penetrates through another mounting hole in the annular frame, a second protruding portion protrudes out of an end, close to each effect sheet, of the second insertion pin, and the second protruding portion abuts against the inner side wall of the annular frame.

18. The effect device easy to mount according to claim 12, wherein the transmission component further comprises a gear ring and a rotating frame, wherein the gear ring coincides with a center shaft of the rotating frame, the rotating frame is fixedly connected with the gear ring, the plurality of transmission shafts are all fixed to the rotating frame, and sawteeth on the gear ring are engaged with a driving wheel of the driving mechanism.

19. The effect device easy to mount according to claim 12, wherein the plurality of effect sheets have a first state and a second state, the plurality of effect sheets are parallel to a center line of the annular frame when the plurality of effect sheets are in the first state, and when the plurality of effect sheets are in the second state, an included angle between the effect sheets and the center line of the annular frame is an acute angle or a right angle.

20. The effect device easy to mount according to claim 12, wherein the plurality of effect sheets are frosting sheets.

* * * * *